US011199116B2

(12) United States Patent
Ostromecki et al.

(10) Patent No.: US 11,199,116 B2
(45) Date of Patent: Dec. 14, 2021

(54) ACOUSTICALLY TUNED MUFFLER

(71) Applicant: Tenneco Automotive Operating Company Inc., Lake Forest, IL (US)

(72) Inventors: Gabriel Ostromecki, Ann Arbor, MI (US); Ankit Barot, Ann Arbor, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 678 days.

(21) Appl. No.: 15/955,252

(22) Filed: Apr. 17, 2018

(65) Prior Publication Data

US 2019/0178124 A1 Jun. 13, 2019

Related U.S. Application Data

(60) Provisional application No. 62/598,147, filed on Dec. 13, 2017.

(51) Int. Cl.
*F01N 1/08* (2006.01)
*F01N 1/00* (2006.01)

(52) U.S. Cl.
CPC ..... *F01N 1/083* (2013.01); *F01N 1/003* (2013.01); *F01N 1/085* (2013.01);
(Continued)

(58) Field of Classification Search
CPC ..... F01N 1/003; F01N 1/023; F01N 1/083; F01N 2490/14; F01N 2490/15;
(Continued)

(56) References Cited

U.S. PATENT DOCUMENTS 1,280,386 A 10/1918 Buehner
1,512,961 A 10/1924 Weil
(Continued)

FOREIGN PATENT DOCUMENTS

CN 101413419 A 4/2009
CN 102230407 A 11/2011
(Continued)

OTHER PUBLICATIONS

International Search Report and Written Opinion regarding PCT/US2018/064897, dated Mar. 21, 2019, 10 pages.
(Continued)

*Primary Examiner* — Jeremy A Luks
(74) *Attorney, Agent, or Firm* — Harness, Dickey & Pierce, P.L.C.

(57) ABSTRACT

A muffler for receiving exhaust gas from a combustion engine may include a shell, an inlet pipe, at least one outlet pipe, one or more baffles, and an internal communication pipe. The inlet pipe may extend through the shell. The outlet pipe may be in fluid communication with the inlet pipe and may be at least partially disposed within the shell. The baffles are disposed within the shell and cooperate with the shell to define a plurality of chambers. The internal communication pipe may be disposed entirely within the shell and may be in fluid communication with the inlet pipe. The internal communication pipe may include an inlet opening and first and outlet openings. The first outlet opening is open to and in direct fluid communication with one of the chambers. The second outlet opening is open to and in direct fluid communication with another one of the chambers.

15 Claims, 9 Drawing Sheets

(52) U.S. Cl.
CPC ..... *F01N 2470/14* (2013.01); *F01N 2470/16* (2013.01); *F01N 2470/18* (2013.01); *F01N 2470/24* (2013.01); *F01N 2490/02* (2013.01); *F01N 2490/155* (2013.01)

(58) Field of Classification Search
CPC ..... F01N 2490/155; F01N 2470/14; F01N 2470/16; F01N 2470/18; F01N 2470/24; F01N 2490/02
See application file for complete search history.

(56) References Cited

U.S. PATENT DOCUMENTS 2,323,955 A 7/1943 Wilson
2,692,025 A 10/1954 Hamilton
2,940,249 A 6/1960 Gospodar
2,975,072 A 3/1961 Bryant
3,072,214 A 1/1963 Deremer
3,109,510 A 11/1963 Phelan
3,209,858 A 10/1965 Jettinghoff
3,209,860 A 10/1965 Lentz
3,209,862 A 10/1965 Young
3,337,939 A 8/1967 Parkinson
3,388,769 A 6/1968 Martoia
3,420,052 A 1/1969 Miller
3,512,607 A * 5/1970 Hubbell ..... F01N 1/02 181/265
3,583,524 A 6/1971 Dubois
3,623,901 A 11/1971 Forstmann et al.
3,643,760 A 2/1972 Hubbell, III
3,709,320 A 1/1973 Hollerl et al.
3,768,987 A 10/1973 Forstmann et al.
3,794,139 A 2/1974 Hetherington et al.
3,827,529 A 8/1974 Frietzsche et al.
3,949,829 A 4/1976 Honda et al.
4,064,963 A 12/1977 Kaan et al.
4,209,076 A * 6/1980 Franco ..... F01N 1/02 181/272
4,359,865 A 11/1982 Nakao et al.
4,756,437 A 7/1988 Rossi-Mossuti
4,909,348 A 3/1990 Harwood et al.
5,052,513 A 10/1991 Yoshikawa et al.
5,168,132 A 12/1992 Beidl et al.
5,265,420 A 11/1993 Rutschmann
5,321,214 A 6/1994 Uegane et al.
5,403,557 A 4/1995 Harris
5,530,213 A 6/1996 Hartsock et al.
5,593,645 A 1/1997 Steenackers et al.
5,907,135 A 5/1999 Hayakawa et al.
6,341,664 B1 1/2002 Gerber
6,598,581 B2 7/2003 Kempf
6,726,957 B2 4/2004 Niemiec
6,830,847 B2 12/2004 Ramaswami et al.
6,889,499 B2 5/2005 Bassani
7,001,675 B2 2/2006 Chan
7,051,523 B2 5/2006 Kerchner
7,377,359 B2 5/2008 Hofmann et al.
7,506,723 B2 3/2009 Hoerr et al.
7,637,349 B2 12/2009 Harada
7,669,693 B2 3/2010 Yamaguchi et al.
7,789,195 B2 9/2010 Mabuchi et al.
7,874,401 B2 1/2011 Uhlemann et al.
7,942,239 B2 5/2011 Huff et al.
7,967,107 B2 6/2011 Han et al.
8,292,026 B2 * 10/2012 Tauschek ..... F01N 1/023 181/251
8,402,756 B2 3/2013 Luce et al.
8,557,397 B2 10/2013 Bullard et al.
8,628,861 B2 1/2014 Bullard et al.
8,684,131 B1 4/2014 Park et al.
8,827,035 B2 9/2014 Ross et al.
9,067,282 B2 6/2015 Sharp
9,095,932 B2 8/2015 Miller et al.
9,096,035 B2 8/2015 Sachdev et al.
9,109,482 B2 8/2015 Fritz et al.
9,121,320 B2 9/2015 Carr et al.
9,341,102 B2 5/2016 Ross et al.
9,393,759 B2 7/2016 Luo et al.
9,429,052 B2 8/2016 Horr
9,623,515 B2 4/2017 Breuer et al.
9,689,301 B2 6/2017 Carr et al.
9,862,058 B2 1/2018 Breuer et al.
2005/0115764 A1 6/2005 Mabuchi et al.
2006/0162995 A1 7/2006 Schorn et al.
2006/0231330 A1 10/2006 Morales et al.
2007/0102236 A1 5/2007 Uhlemann et al.
2007/0227807 A1 10/2007 Meneely et al.
2008/0093161 A1 4/2008 Winkel et al.
2008/0093162 A1 4/2008 Marocco et al.
2008/0196969 A1 8/2008 Henke et al.
2009/0000862 A1 1/2009 Buell et al.
2009/0229913 A1 9/2009 Tonietto et al.
2009/0249603 A1 10/2009 Vargas
2011/0083924 A1 4/2011 Park
2011/0272209 A1 11/2011 Tauschek et al.
2013/0171471 A1 7/2013 Bullard et al.
2013/0206271 A1 8/2013 Wieser et al.
2013/0213734 A1 8/2013 Ahn et al.
2014/0027414 A1 1/2014 Lin et al.
2014/0144721 A1 5/2014 Park
2014/0151149 A1 6/2014 Ross et al.
2015/0008068 A1 1/2015 Hamashima et al.
2015/0354421 A1 12/2015 Horr
2016/0340786 A1 11/2016 Mukai et al.
2017/0080523 A1 3/2017 Andersson et al.
2017/0218831 A1 8/2017 DeVouge et al.
2019/0321914 A1 10/2019 Denney et al.
2020/0232376 A1 7/2020 Quan
2020/0232377 A1 7/2020 Quan et al.

FOREIGN PATENT DOCUMENTS

CN 103603707 A 2/2014
CN 204163804 U 2/2015
CN 103014694 B 4/2015
CN 204851384 U 12/2015
CN 105813837 A 7/2016
CN 205840974 U 12/2016
CN 106285879 A 1/2017
DE 2706957 A1 8/1978
DE 2856889 A1 11/1980
DE 2839756 C2 8/1984
DE 102004039006 A1 2/2006
DE 102013106651 A1 1/2015
EP 0047678 A1 3/1982
EP 0328056 A2 8/1989
EP 0523008 B1 9/1996
EP 0808877 B1 9/2003
EP 1918544 A1 5/2008
EP 3112654 A1 1/2017
GB 1393232 A 5/1975
JP S6338524 B2 8/1988
JP S63285213 A 11/1988
JP 10296090 A 11/1998
JP H11140665 A 5/1999
JP 2000337126 A 12/2000
JP 2006144707 A 6/2006
JP 3853903 B2 12/2006
JP 2007308737 A 11/2007
JP 2009072695 A 4/2009
JP 2009215941 A 9/2009
JP 2010255520 A 11/2010
JP 2011027038 A 2/2011
JP 2011085113 A 4/2011
JP 4691707 B2 6/2011
JP 5335595 B2 11/2013
JP 2013238160 A 11/2013
JP 5529839 B2 6/2014
JP 2015063985 A 4/2015
JP 5992768 B2 9/2016
JP 6443138 B2 12/2018
KR 100797823 B1 1/2008
KR 20090071167 A 7/2009

(56) References Cited

FOREIGN PATENT DOCUMENTS

| | | | |
|---|---|---|---|
| KR | 101262612 | B1 | 5/2013 |
| WO | 2016206915 | A1 | 12/2016 |
| WO | WO-201750711 | A1 | 3/2017 |

OTHER PUBLICATIONS

Office Action regarding Chinese Patent Application No. 202010032630.2, dated Jul. 27, 2021.

* cited by examiner

ACOUSTICALLY TUNED MUFFLER

CROSS-REFERENCE TO RELATED APPLICATIONS

This application claims the benefit of U.S. Provisional Application No. 62/598,147, filed on Dec. 13, 2017. The entire disclosure of the above application is incorporated herein by reference.

FIELD

The present disclosure relates to an acoustically tuned muffler, and particularly, to an acoustically tuned muffler for an exhaust system for a combustion engine.

BACKGROUND

This section provides background information related to the present disclosure and is not necessarily prior art.

An internal combustion engine can generate a substantial amount of combustion noise, which is transferred through an exhaust system and is audible as tailpipe noise. Mufflers are used within exhaust systems to reduce this noise and/or tune the exhaust sound characteristics so that the tailpipe noise has desired sound qualities. Tradeoffs between packaging space, flow performance, and sound characteristics are often made in the design of a muffler. The present disclosure provides a muffler that fits within limited space on a vehicle while providing a desired level of performance and desired sound characteristics.

SUMMARY

This section provides a general summary of the disclosure, and is not a comprehensive disclosure of its full scope or all of its features.

The present disclosure provides a muffler for receiving exhaust gas from a combustion engine. The muffler may include a shell, an inlet pipe, a first outlet pipe, at least one baffle, and an internal communication pipe. The inlet pipe may extend through the shell. The first outlet pipe may be in fluid communication with the inlet pipe and may be at least partially disposed within the shell. The at least one baffle is disposed within the shell and cooperates with the shell to define a plurality of chambers within the shell. The chambers are separated from each other by the at least one baffle. The internal communication pipe may be disposed entirely within the shell and may be in fluid communication with the inlet pipe. The internal communication pipe may include an inlet opening, a first outlet opening, and a second outlet opening. The first outlet opening may be open to and in direct fluid communication with one of the chambers. The second outlet opening may be open to and in direct fluid communication with another one of the chambers.

In some configurations of the muffler of the above paragraph, the inlet opening is formed in a first end of the internal communication pipe, the first outlet opening is formed in a second end of the internal communication pipe, and the second outlet opening is disposed between the first and second ends.

In some configurations of the muffler of any one or more of the above paragraphs, the second outlet opening is formed in a neck that extends radially outward from a main body of the internal communication pipe.

In some configurations of the muffler of any one or more of the above paragraphs, the second outlet opening extends radially through inner and outer diametrical surfaces of the internal communication pipe.

In some configurations of the muffler of any one or more of the above paragraphs, the internal communication pipe includes a plurality of second outlet openings disposed between the first and second ends of the internal communication pipe.

In some configurations of the muffler of any one or more of the above paragraphs, the internal communication pipe includes a first pipe section and a second pipe section. A portion of the second pipe section may be received within first pipe section such that an annular space is defined between an outer diametrical surface of the second pipe section and an inner diametrical surface of the first pipe section.

In some configurations of the muffler of any one or more of the above paragraphs, the muffler includes a plurality of baffles disposed within the shell and cooperating with the shell to define a plurality of chambers within the shell. The chambers are separated from each other by at least one of the baffles.

In some configurations of the muffler of any one or more of the above paragraphs, the internal communication pipe extends through at least two of the baffles and extends at least partially through at least three of the chambers.

In some configurations of the muffler of any one or more of the above paragraphs, one of the at least two baffles includes one or more apertures allowing direct fluid communication between two adjacent chambers.

In some configurations of the muffler of any one or more of the above paragraphs, one of the at least two baffles separates the chamber that is open to the first outlet opening from the chamber that is open to the second outlet opening.

In some configurations of the muffler of any one or more of the above paragraphs, the muffler includes a second outlet pipe in fluid communication with the inlet pipe and at least partially disposed within the shell.

In some configurations of the muffler of any one or more of the above paragraphs, the first and second outlet pipes are axially aligned with each other.

In some configurations of the muffler of any one or more of the above paragraphs, the inlet pipe, the first and second outlet pipes and the internal communication pipe are fluidly coupled to a four-way junction disposed within the shell.

In some configurations of the muffler of any one or more of the above paragraphs, the four-way junction is disposed within the fourth chamber.

In some configurations of the muffler of any one or more of the above paragraphs, exhaust gas within an interior of the four-way junction is fluidly isolated from the exhaust gas within the fourth chamber.

In some configurations of the muffler of any one or more of the above paragraphs, the one of the chambers in direct fluid communication with the first outlet opening of the internal communication pipe is a first dead chamber.

In some configurations of the muffler of any one or more of the above paragraphs, the one of the chambers in direct fluid communication with the second outlet opening of the internal communication pipe is a second dead chamber.

The present disclosure also provides a muffler that may include a shell, an inlet pipe, a first outlet pipe, a second outlet pipe, and an internal communication pipe. The shell may define an internal volume containing a first baffle, a second baffle, a third baffle and a fourth baffle. The shell may cooperate with the first baffle to define a first chamber. The shell may cooperate with the first and second baffles to define a second chamber. The shell may cooperate with the second and third baffles to define a third chamber. The shell may cooperate with the third and fourth baffles to define a fourth chamber. The shell cooperating with the fourth baffle to define a fifth chamber. The inlet pipe may extend through the shell into the fourth chamber. Exhaust gas may exit the muffler through the first outlet pipe. The first outlet pipe may be in fluid communication with the inlet pipe and may extend through the first, second, and third baffles. Exhaust gas may exit the muffler through the second outlet pipe. The second outlet pipe may be in fluid communication with the inlet pipe and may extend through the fourth baffle. The internal communication pipe may be disposed entirely within the shell and may be in fluid communication with the inlet pipe. The internal communication pipe may include an inlet opening disposed in the fourth chamber, a first outlet opening disposed within the second chamber, and a second outlet opening disposed within the third chamber.

In some configurations of the muffler of the above paragraph, the inlet opening is formed in a first end of the internal communication pipe, the first outlet opening is formed in a second end of the internal communication pipe, and the second outlet opening is disposed between the first and second ends.

In some configurations of the muffler of any one or more of the above paragraphs, the second outlet opening is formed in a neck that extends radially outward from a main body of the internal communication pipe.

In some configurations of the muffler of any one or more of the above paragraphs, the second outlet opening extends radially through inner and outer diametrical surfaces of the internal communication pipe.

In some configurations of the muffler of any one or more of the above paragraphs, the internal communication pipe includes a plurality of second outlet openings disposed between the first and second ends of the internal communication pipe.

In some configurations of the muffler of any one or more of the above paragraphs, the internal communication pipe includes a first pipe section and a second pipe section. A portion of the second pipe section may be received within first pipe section such that an annular space is defined between an outer diametrical surface of the second pipe section and an inner diametrical surface of the first pipe section.

In some configurations of the muffler of any one or more of the above paragraphs, a first end of the first pipe section is disposed in the fourth chamber and a second end of the first pipe section is disposed in the third chamber. The second pipe section may extend through the second end of the first pipe section and into the second chamber.

In some configurations of the muffler of any one or more of the above paragraphs, the internal communication pipe extends through the second and third baffles and extends at least partially through the second, third and fourth chambers.

In some configurations of the muffler of any one or more of the above paragraphs, the first and second outlet pipes are axially aligned with each other.

In some configurations of the muffler of any one or more of the above paragraphs, the second baffle separates the second chamber from the third chamber such that the second and third chambers are in fluid communication with each other only via the internal communication pipe.

In some configurations of the muffler of any one or more of the above paragraphs, the first baffle includes one or more apertures allowing direct fluid communication between the first and second chambers.

In some configurations of the muffler of any one or more of the above paragraphs, the third baffle includes one or more apertures allowing direct fluid communication between the third and fourth chambers.

In some configurations of the muffler of any one or more of the above paragraphs, the fourth baffle includes one or more apertures allowing direct fluid communication between the fourth and fifth chambers.

In some configurations of the muffler of any one or more of the above paragraphs, the inlet pipe, the first and second outlet pipes and the internal communication pipe are fluidly coupled to a four-way junction disposed within the shell.

In some configurations of the muffler of any one or more of the above paragraphs, the four-way junction is disposed within the fourth chamber.

In some configurations of the muffler of any one or more of the above paragraphs, exhaust gas within an interior of the four-way junction is fluidly isolated from the exhaust gas within the fourth chamber.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
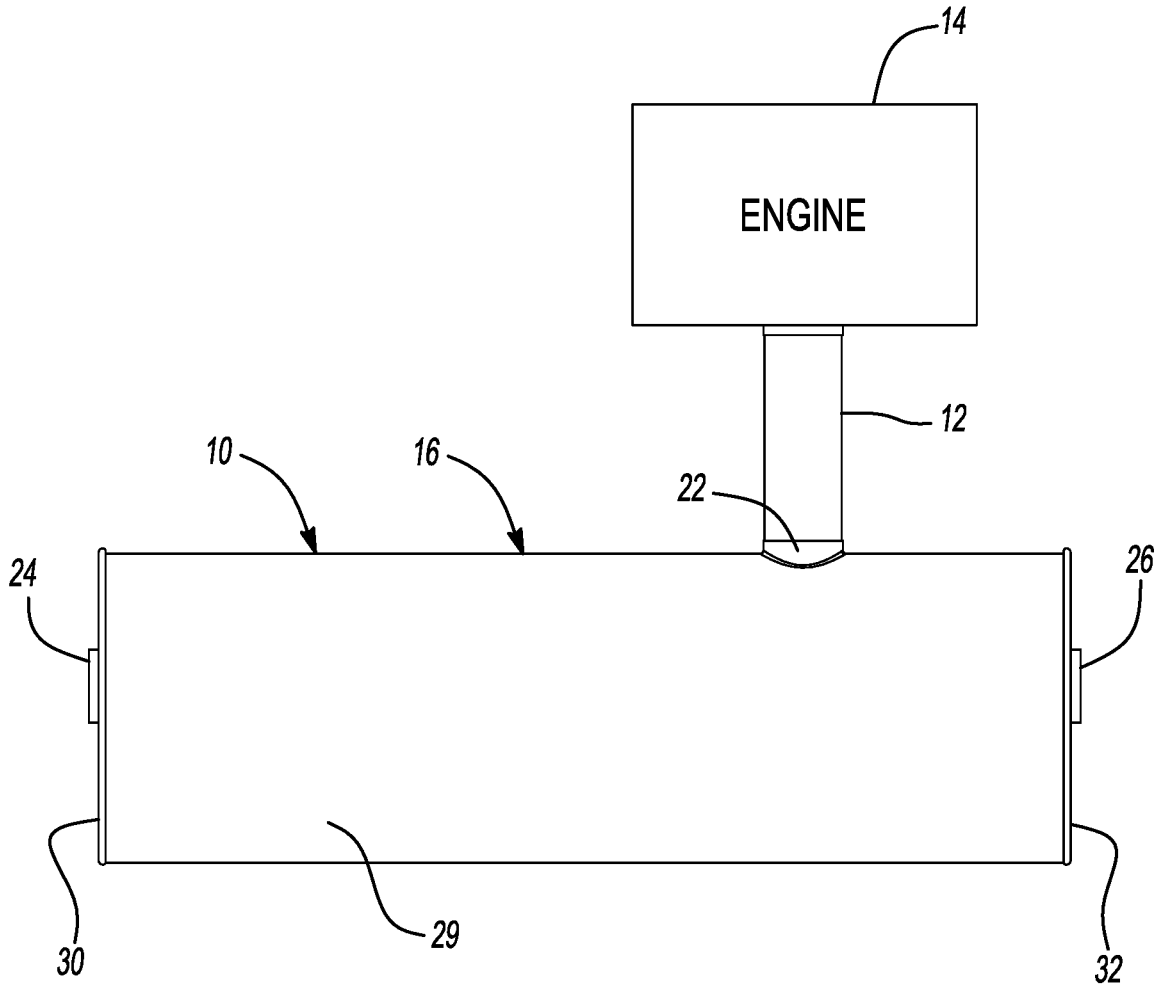
FIG. 1 is a schematic representation of an engine and exhaust system having a muffler according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
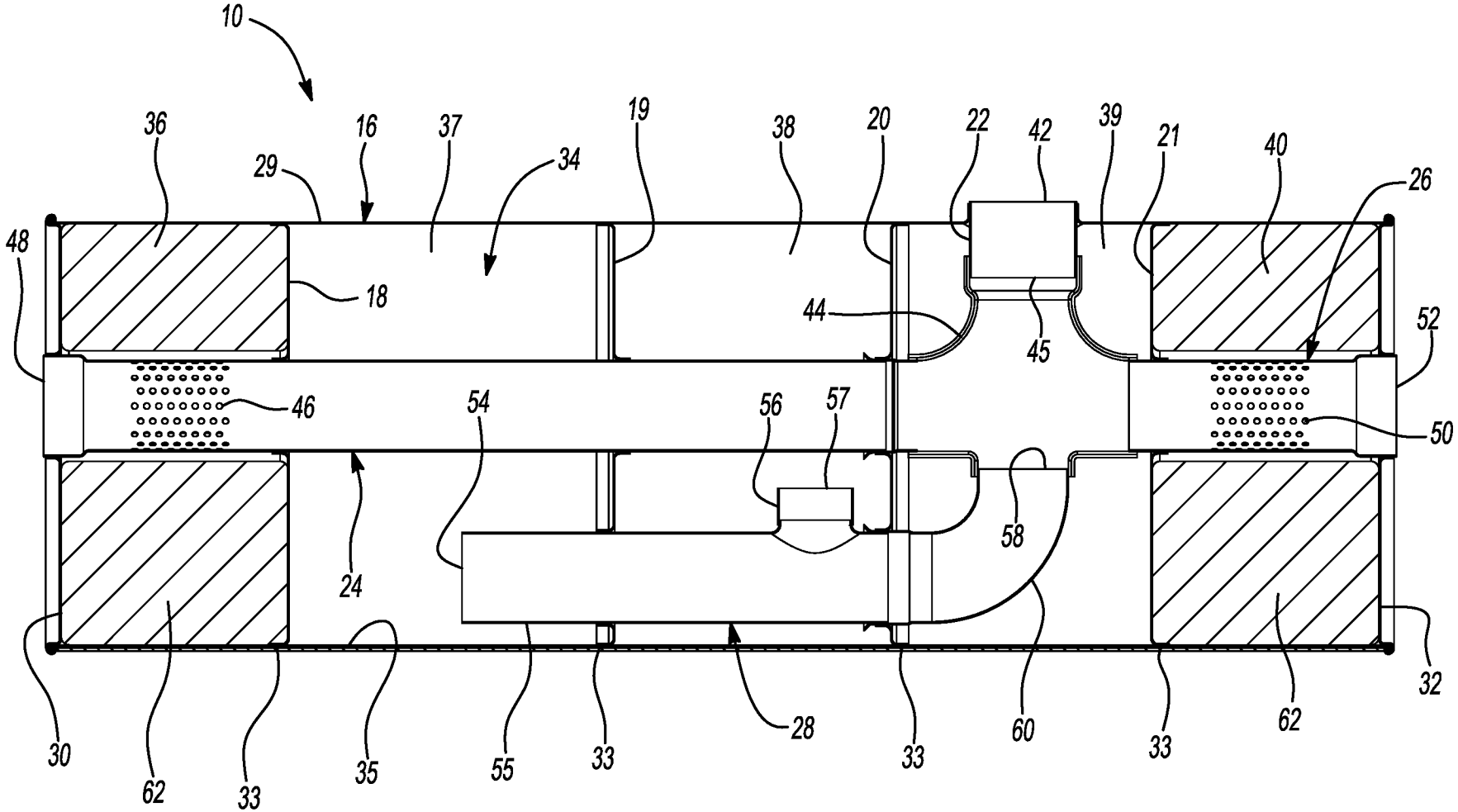
FIG. 2 is a cross-sectional view of the muffler of FIG. 1.
Figure 3:
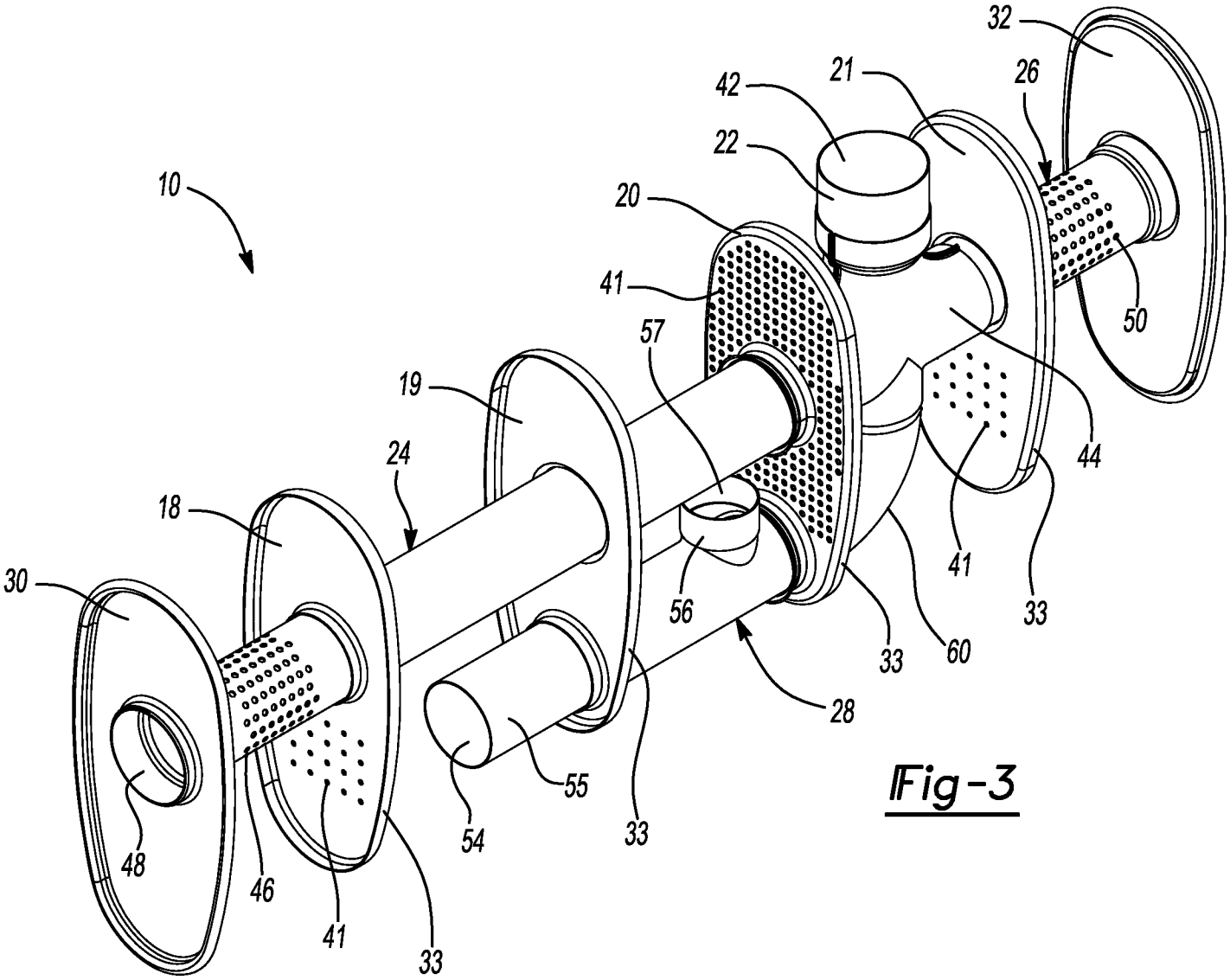
FIG. 3 is a perspective view of the muffler with a portion of an outer shell of the muffler removed.

With reference to FIGS. 1-3, a muffler 10 is provided that may receive exhaust gas from one or more exhaust pipes 12 (shown schematically in FIG. 1) connected to a combustion engine 14 (shown schematically in FIG. 1). The muffler 10 and exhaust pipes 12 are parts of an exhaust system that may include additional exhaust aftertreatment components (not shown). The muffler 10 may be shaped to fit within a given available space on a vehicle (not shown). For example, in some configurations, the muffler 10 may be shaped to fit around a spare tire well of the vehicle and/or other components at or near an undercarriage of the vehicle.

Referring now to FIGS. 2 and 3, the muffler 10 may include a shell 16, a first internal baffle 18, a second internal baffle 19, a third internal baffle 20, a fourth internal baffle 21, an inlet pipe 22, a first outlet pipe 24, a second outlet pipe 26, and an internal communication pipe (or tuning tube) 28. The shell 16 may include a main shell body 29, first end cap 30 and a second end cap 32. The first and second end caps 30, 32 may be fixed to respective axial ends of the main shell body 29 and may cooperate with the main shell body 29 to define an internal volume 34. The first and second end caps 30, 32 may be welded, mechanically locked, or otherwise sealingly fixed onto the axial ends of the main shell body 29. In some configurations, the shell 16 could have a "clamshell" configuration whereby the shell 16 includes two shell halves (or two shell portions) that are welded, mechanically locked, or otherwise sealingly fixed together. In some of such configurations, some or all of each end cap 30, 32 could be integrally formed with or attached to the shell halves (or portions) of the shell 16. Other multi-piece shell configurations are contemplated. For example, the muffler 10 could include an outer shell surrounding an inner shell.

The first, second, third and fourth internal baffles 18, 19, 20, 21 may be disposed within the shell 16 and between the first and second end caps 30, 32. That is, the internal baffles 18, 19, 20, 21 may be disposed within the internal volume 34. The outer peripheries 33 of the internal baffles 18, 19, 20, 21 may be shaped to generally match the contours of an inner circumferential wall 35 of the shell 16. The outer peripheries 33 of the internal baffles 18, 19, 20, 21 may be welded, mechanically locked, or otherwise sealingly fixed to the inner circumferential wall 35.

The first, second, third and fourth internal baffles 18, 19, 20, 21 may divide the internal volume 34 into a first enclosed chamber 36, a second enclosed chamber 37, a third enclosed chamber 38, a fourth enclosed chamber 39, and a fifth enclosed chamber 40. The first chamber 36 may be defined by the first internal baffle 18, the first end cap 30, and the shell 16. The second chamber 37 may be defined by the first and second internal baffles 18, 19 and the shell 16. The third chamber 38 may be defined by the second and third internal baffles 19, 20 and the shell 16. The fourth chamber 39 may be defined by the third and fourth internal baffles 20, 21 and the shell 16. The fifth chamber 40 may be defined by the fourth internal baffle 21, the second end cap 32, and the shell 16.

One of the more of the internal baffles 18, 19, 20, 21 may include one or more openings or apertures 41 (FIG. 3) to allow fluid communication among some of all of the chambers 36, 37, 38, 39, 40. In the configuration shown in the figures, the first, third, and fourth internal baffles 18, 20, 21 include apertures 41 (see FIG. 3). The apertures 41 in the first internal baffle 18 allow for fluid communication between the first and second chambers 36, 37. The apertures 41 in the third and fourth internal baffles 20, 21 allow for fluid communication among the third, fourth and fifth chambers 38, 39, 40. In the configuration shown in the figures, the second internal baffle 19 does not include apertures to allow fluid communication directly between the second and third chambers 37, 38. Instead, exhaust gas may communicate between the second and third chambers 37, 38 via the internal communication pipe 28.

The inlet pipe 22 may extend through the shell 16 and into the fourth chamber 39. The inlet pipe 22 may be fluidly coupled with the exhaust pipe 12 (as shown in FIG. 1) via an inlet opening 42 of the inlet pipe 22. The inlet pipe 22 may be fluidly coupled with a four-way junction 44 via an outlet opening 45 of the inlet pipe 22. The four-way junction 44 (e.g., a manifold or pipe-connector with four openings) may also be fluid communication with the first and second outlet pipes 24, 26 and the internal communication pipe 28 so that fluid entering the muffler 10 through the inlet pipe 22 can flow into the four-way junction and then into any of the first and second outlet pipes 24, 26 and the internal communication pipe 28. The four-way junction 44 may be disposed within the fourth chamber 39. In some configurations, the four-way junction 44 may be formed from two pieces that are welded or otherwise fixedly attached to each other.

The first outlet pipe 24 may extend from the four-way junction 44 through the third internal baffle 20, through the third chamber 38, through the second internal baffle 19, through the second chamber 37, through the first internal baffle 18, through the first chamber 36, and through the first end cap 30. A portion of the first outlet pipe 24 that is disposed in the first chamber 36 (i.e., the portion disposed between the first end cap 30 and the first internal baffle 18) may include one or more openings or apertures 46 that extend radially through inner and outer diametrical surfaces of the first outlet pipe 24. In this manner, the one or more apertures 46 provide direct fluid communication between the first chamber 36 and the first outlet pipe 24. An outlet opening 48 of the first outlet pipe 24 may be open to the ambient environment surrounding the muffler 10, or the outlet opening 48 could be coupled to another exhaust system component outside of the muffler 10 (e.g., a tailpipe; not shown).

The second outlet pipe 26 may extend from the four-way junction 44 through the fourth internal baffle 21, through the fifth chamber 40, and through the second end cap 32. A portion of the second outlet pipe 26 that is disposed in the fifth chamber 40 (i.e., the portion disposed between the second end cap 32 and the fourth internal baffle 21) may include one or more openings or apertures 50 that extend radially through inner and outer diametrical surfaces of the second outlet pipe 26. In this manner, the one or more apertures 50 provide direct fluid communication between the fifth chamber 40 and the second outlet pipe 26. An outlet opening 52 of the second outlet pipe 26 may be open to the ambient environment surrounding the muffler 10, or the outlet opening 52 could be coupled to another exhaust system component outside of the muffler 10 (e.g., a tailpipe; not shown).

In the configuration shown in the figures, the first and second outlet pipes 24, 26 are both straight pipes. Furthermore, in the configuration shown in the figures, the first and second outlet pipes 24, 26 are axially aligned with each other (i.e., longitudinal axes of the first and second outlet pipes 24, 26 are substantially collinear). In some configurations, one or both of the outlet pipes 24, 26 could include curves or bends and/or some or all of the first outlet pipe 24 may be axially misaligned with some of the second outlet pipe 26.

The internal communication pipe 28 may extend from the four-way junction 44 through the third internal baffle 20, through the third chamber 38, through the second internal baffle 19, and into the second chamber 37. An outlet opening 54 formed in a distal axial end of the internal communication pipe 28 may be open to and in fluid communication with the second chamber 37. The internal communication pipe 28 may have an approximately ninety-degree bend 60 disposed in the fourth chamber 39 proximate an inlet opening 58 of the internal communication pipe 28. The inlet pipe 22 may be axially aligned with the inlet opening 58 of the communication pipe 28 such that the communication pipe 28 forms a direct driven Helmholtz tuner. The axial alignment of the inlet pipe 22 with the inlet opening 58 provides for improved noise cancellation or dampening since the momentum of the exhaust gas flowing through the inlet pipe 22 carries sound waves directly into the inlet opening 58 of the communication pipe 28.

The internal communication pipe 28 may be a dual Helmholtz tuner. A main body 55 of the pipe 28 opens into the second chamber 37 (via the outlet opening 54) and functions a first Helmholtz tuner (i.e., a direct driven tuner). A Helmholtz neck 56 (i.e., a second Helmholtz tuner) may extend radially into the third chamber 38 from an intermediate portion of the internal communication pipe 28 (i.e., at a location between the outlet opening 54 and the inlet opening 58 of the internal communication pipe 28). The Helmholtz neck 56 includes an outlet opening (or aperture) 57 that is in direct fluid communication with the third chamber 38.

During operation of the engine 14, exhaust gas discharged from the engine 14 flows through the exhaust pipe 12 to the inlet pipe 22 of the muffler 10. From the inlet pipe 22, the exhaust gas flows into the four-way junction 44. A portion of the exhaust gas in the four-way junction 44 may flow into the first outlet pipe 24 and exit the muffler 10 through the outlet opening 48. Another portion of the exhaust gas in the four-way junction 44 may flow into the second outlet pipe 26 and exit the muffler 10 through the outlet opening 52. Another portion of the exhaust gas in the four-way junction 44 may flow into the internal communication pipe 28. As exhaust gas from the four-way junction 44 flows through the internal communication pipe 28, sound waves may travel through the Helmholtz neck 56 and into the third chamber 38, thereby reducing noise. The apertures 46 in the first outlet pipe 24 in communication with the first chamber 36 and the apertures 50 in the second outlet pipe 26 in communication with the fifth chamber 40 function as secondary resonators that further reduce noise.

The shapes, lengths and diameters of the pipes 22, 24, 26, 28, volumes of the chambers 36, 37, 38, 39, 40, the size (length and diameter) and location of the Helmholtz neck 56, and/or the positioning of the pipes 22, 24, 26, 28 relative to each other (e.g., whether the outlet pipes 24, 26 are axially aligned and/or whether the inlet pipe 22 is axially aligned with the inlet opening 58 of the communication pipe 28) may be tailored to achieve a desired range of sounds and desired performance characteristics over a given range of engine speeds.

In some configurations, the first chamber 36 and the fifth chamber 40 may contain roving 62 (shown schematically in FIG. 2). The roving 62 may include fibrous material such as strands of fiberglass and/or other insulating materials that absorb sound (e.g., high-frequency sound) and dampen energy in the first and fifth chambers 36, 40.

While the configuration shown in the figures includes the four-way junction 44 fluidly coupling the pipes 22, 24, 26, 28, in some configurations, the pipes 22, 24, 26, 28 may be open to a common chamber (defined by baffles) instead of the four-way junction 44.

Figure 4:
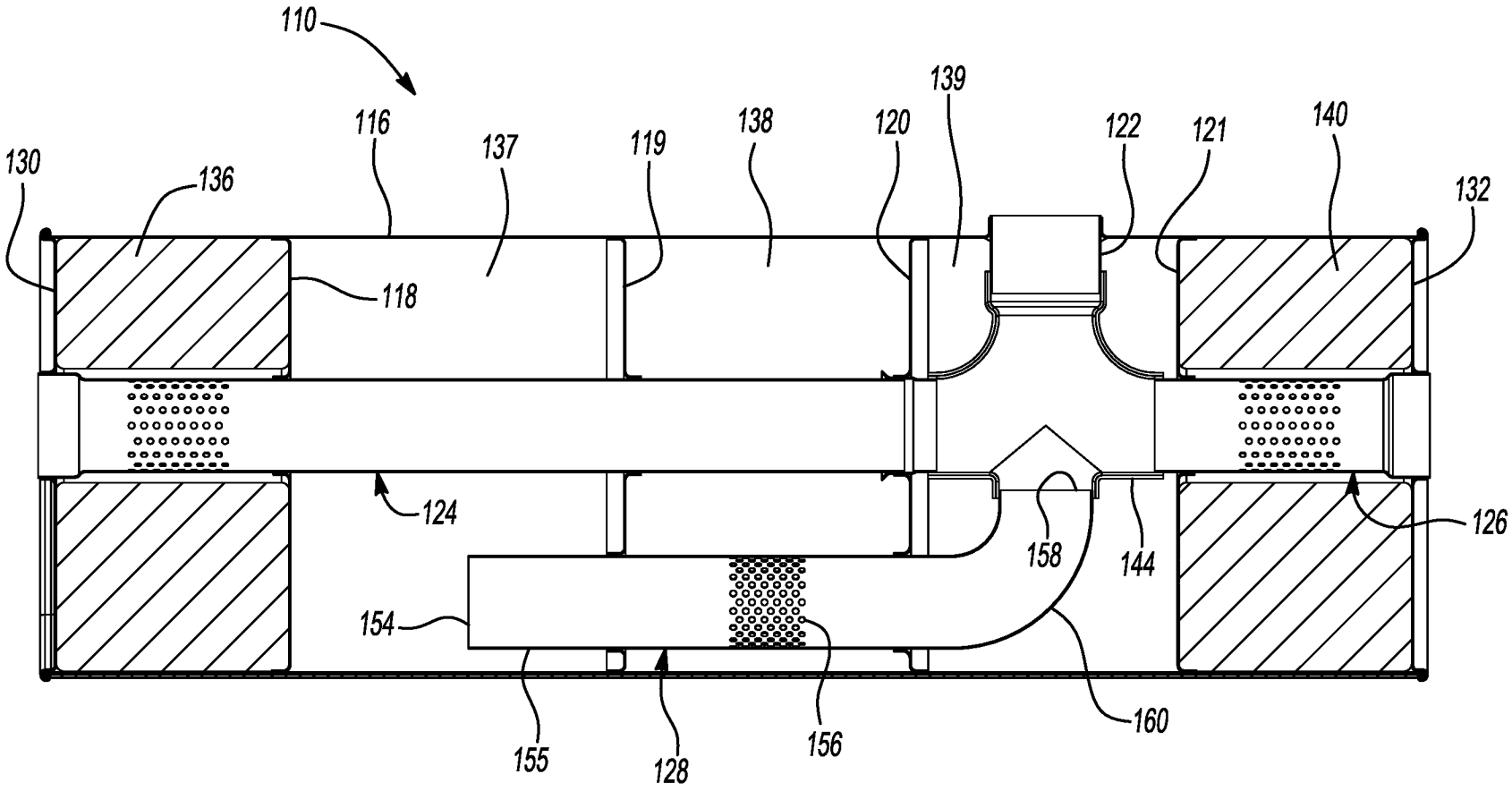
FIG. 4 is a cross-sectional view of another muffler according to the principles of the present disclosure.
Figure 5:
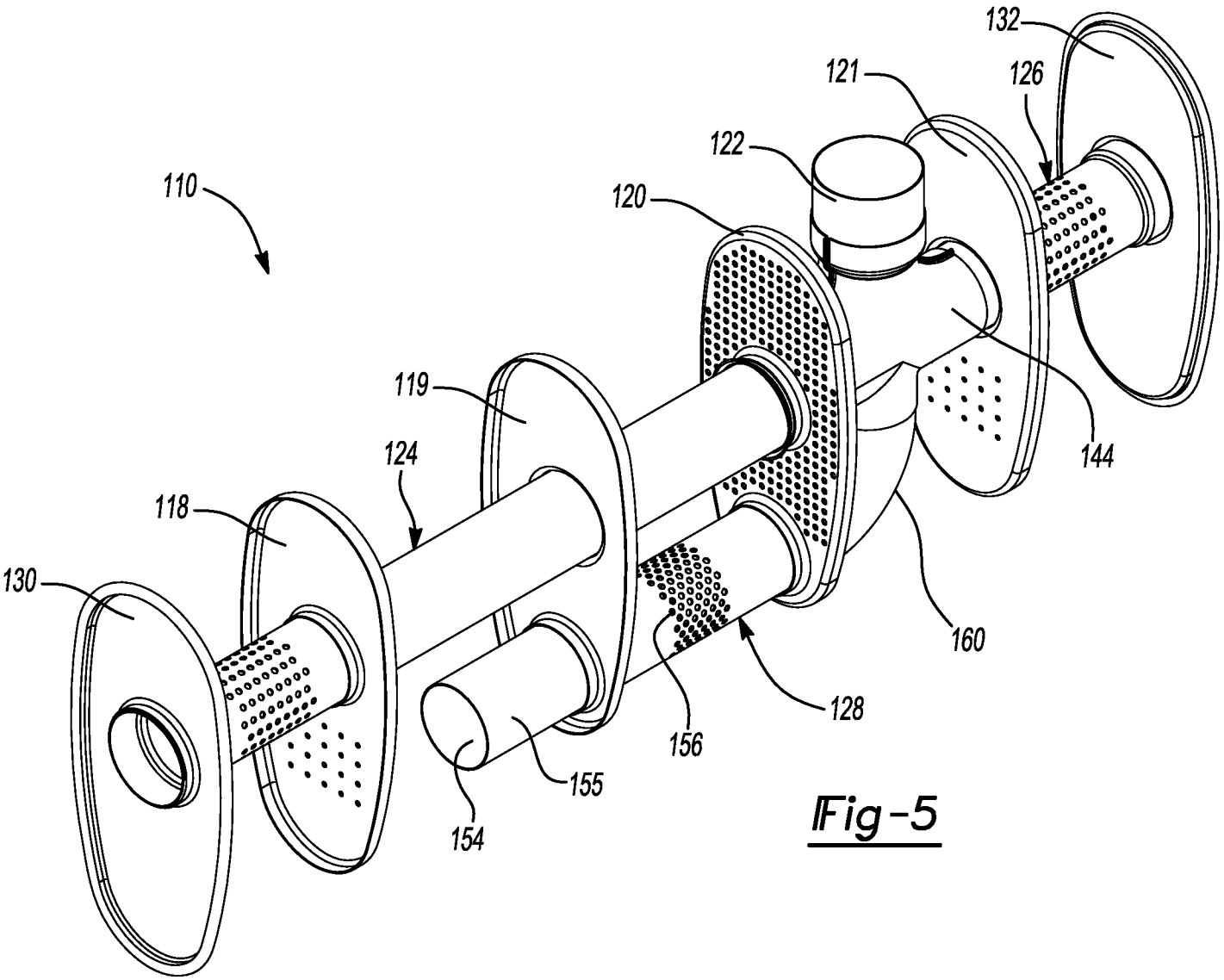
FIG. 5 is a perspective view of the muffler of FIG. 4 with a portion of an outer shell of the muffler removed.

Referring now to FIGS. 4 and 5, another muffler 110 is provided. Like the muffler 10, the muffler 110 may include a shell 116 (including a main body and first and second end caps 130, 132), a first internal baffle 118, a second internal baffle 119, a third internal baffle 120, a fourth internal baffle 121, an inlet pipe 122, a first outlet pipe 124, a second outlet pipe 126, and an internal communication pipe (or tuning tube) 128, a first chamber 136, a second chamber 137, a third chamber 138, a fourth chamber 139, and a fifth chamber 140. The structure and function of these components of the muffler 110 may be similar or identical to that of the corresponding components of the muffler 10 described above, apart from differing features described below and/or shown in the figures. Therefore, some similar features are not described again in detail.

Like the internal communication pipe 28 described above, the internal communication pipe 128 may extend from four-way junction 144 in the fourth chamber 139 through the third internal baffle 120, through the third chamber 138, through the second internal baffle 119, and into the second chamber 137. An outlet opening 154 formed in a distal axial end of the internal communication pipe 128 may be open to and in fluid communication with the second chamber 137. The internal communication pipe 128 may have an approximately ninety-degree bend 160 disposed in the fourth chamber 139 proximate an inlet opening 158 of the internal communication pipe 128. The inlet pipe 122 may be axially aligned with the inlet opening 158 of the communication pipe 128.

The internal communication pipe 128 may be a dual Helmholtz tuner. A main body 155 of the pipe 128 opens into the second chamber 137 (via the outlet opening 54) and functions a first Helmholtz tuner (i.e., a driven tuner). A plurality of apertures (openings or perforations) 156 may extend radially through inner and outer diametrical surfaces of an intermediate portion of the internal communication pipe 128 that is disposed in the third chamber 138 from an intermediate portion of the internal communication pipe 128 (i.e., at a location between the outlet opening 154 and the inlet opening 158 of the internal communication pipe 128). The apertures 156 may function as a second Helmholtz tuner.

Figure 6:
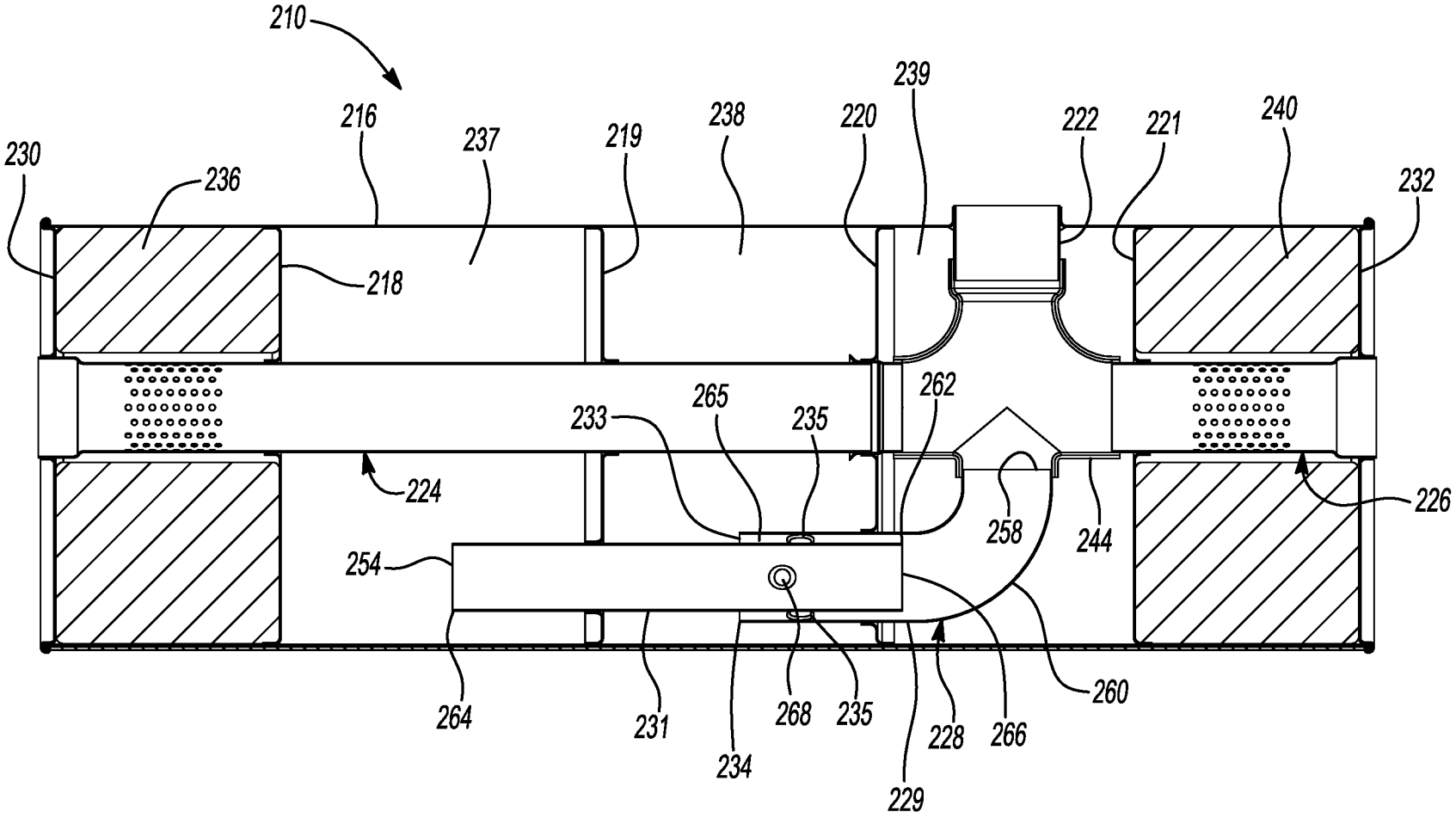
FIG. 6 is a cross-sectional view of yet another muffler according to the principles of the present disclosure.
Figure 7:
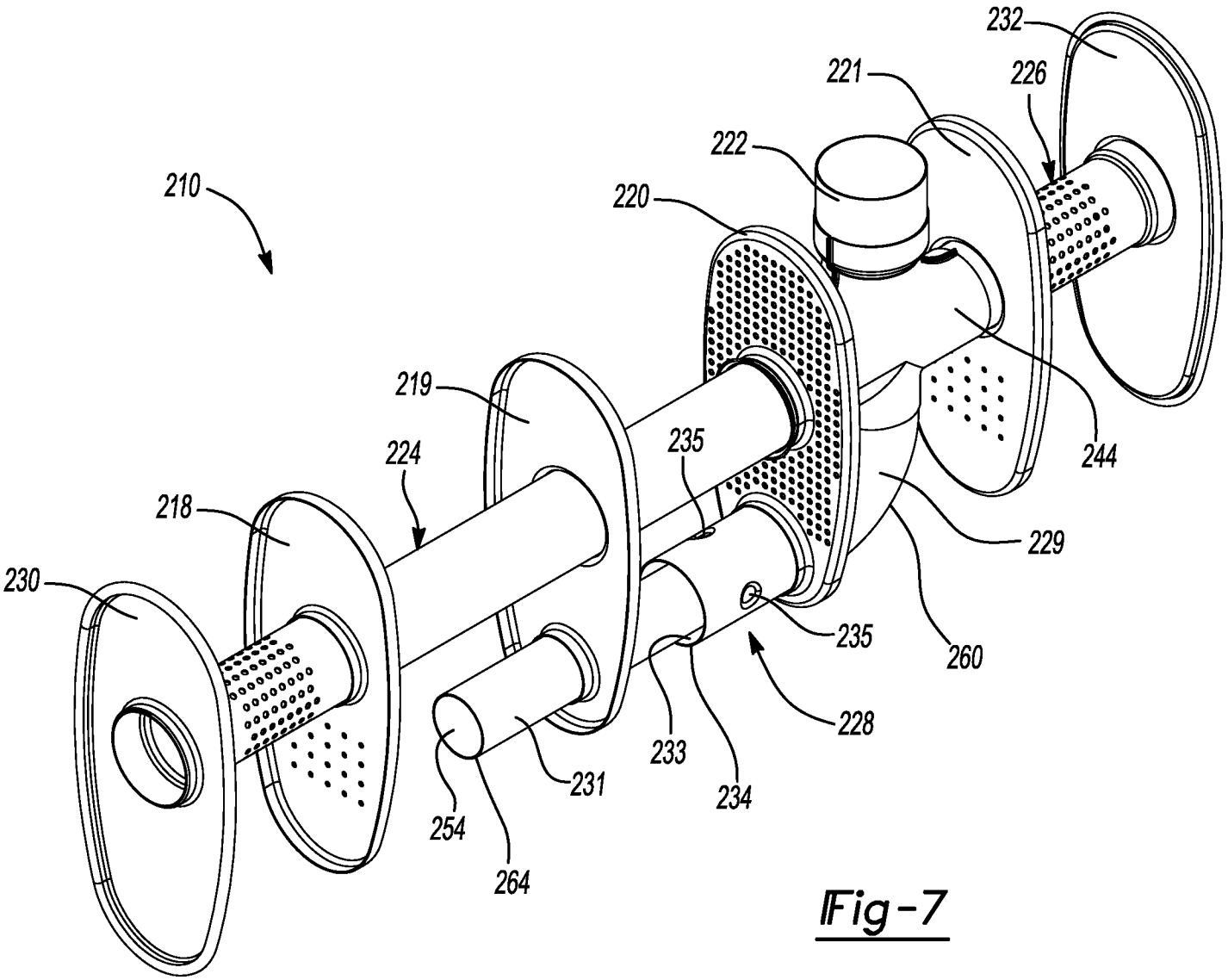
FIG. 7 is a perspective view of the muffler of FIG. 6 with a portion of an outer shell of the muffler removed.

Referring now to FIGS. 6 and 7, another muffler 210 is provided. Like the muffler 10, the muffler 210 may include a shell 216 (including a main body and first and second end caps 230, 232), a first internal baffle 218, a second internal baffle 219, a third internal baffle 220, a fourth internal baffle 221, an inlet pipe 222, a first outlet pipe 224, a second outlet pipe 226, and an internal communication pipe (or tuning tube) 228, a first chamber 236, a second chamber 237, a third chamber 238, a fourth chamber 239, and a fifth chamber 240. The structure and function of these components of the muffler 210 may be similar or identical to that of the corresponding components of the muffler 10 described above, apart from differing features described below and/or shown in the figures. Therefore, some similar features are not described again in detail.

Like the internal communication pipe 28 described above, the internal communication pipe 228 may extend from four-way junction 244 in the fourth chamber 239 through the third internal baffle 220, through the third chamber 238, through the second internal baffle 219, and into the second chamber 237. The internal communication pipe 228 may be a dual Helmholtz tuner and may include a first pipe section 229 and a second pipe section 231.

The first pipe section 229 may be attached to the four-way junction 244 and may include an inlet opening 258 that is axially aligned with the inlet pipe 222. The first pipe section 229 may include an approximately ninety-degree bend 260 disposed in the fourth chamber 239. The first pipe section 229 may extend through the third internal baffle 220 and a distal axial end 234 of the first pipe section 229 may be disposed in the third chamber 238. The distal axial end 234 of the first pipe section 229 may include an opening 233. One or more dimples or protrusions 235 may extend radially inward from the inner diametrical surface of the first pipe section 229 at a location between the bend 260 and the distal axial end 234 of the first pipe section 229. The dimples 235 may contact the outer diametrical surface of the second pipe section 231 to position the second pipe section 231 concentric to the first pipe section 229.

The second pipe section 231 may be partially received in the first pipe section 229. The second pipe section 231 may be a straight pipe and may be substantially concentric with the portion of the first pipe section 229 (i.e., the portion between the bend 260 and the distal axial end 234 of the first pipe section 229). An outer diameter of the second pipe section 231 may be smaller than the inner diameter of the first pipe section 229 such that an annular space 265 is defined between the inner diametrical surface of the first pipe section 229 and the outer diametrical surface of the second pipe section 231.

The second pipe section 231 may include a first axial end 262 and a second axial end 264. The first axial end 262 may include an opening 266 and may be disposed within the first pipe section 229 between the bend 260 and the axial end 234. A portion of the second pipe section 231 that is disposed within the first pipe section 229 may include one or more dimples or protrusions 268 that extend radially outward from the outer diametrical surface of the second pipe section 231. The dimples 268 of the second pipe section 231 may contact the inner diametrical surface of the first pipe section 229. In this manner, the dimples 268 and the dimples 235 cooperate to position the second pipe section 231 concentric to the first pipe section 229.

The second pipe section 231 may extend through the opening 233 in the distal axial end 234 of the first pipe section 229, through the third chamber 238, through the second internal baffle 219 and into the second chamber 237. An outlet opening 254 formed in the second axial end 264 of the second pipe section 231 may be open to and in fluid communication with the second chamber 237.

The first and second pipe sections 229, 231 may function as dual Helmholtz tuners. In operation, some of the exhaust gas in the four-way junction 244 may enter the first pipe section 229 through the inlet opening 258. A portion of the exhaust gas in the first pipe section 229 may flow into the annular space 265 between the first and second pipe sections 229, 231 and may flow into the third chamber 238 via the opening 233 at the distal end 234 of the first pipe section 229. Another portion of the exhaust gas in the first pipe section 229 may flow into the opening 266 of the second pipe section 231, through the second pipe section 231 and into the second chamber 237 through the outlet opening 254.

Figure 8:
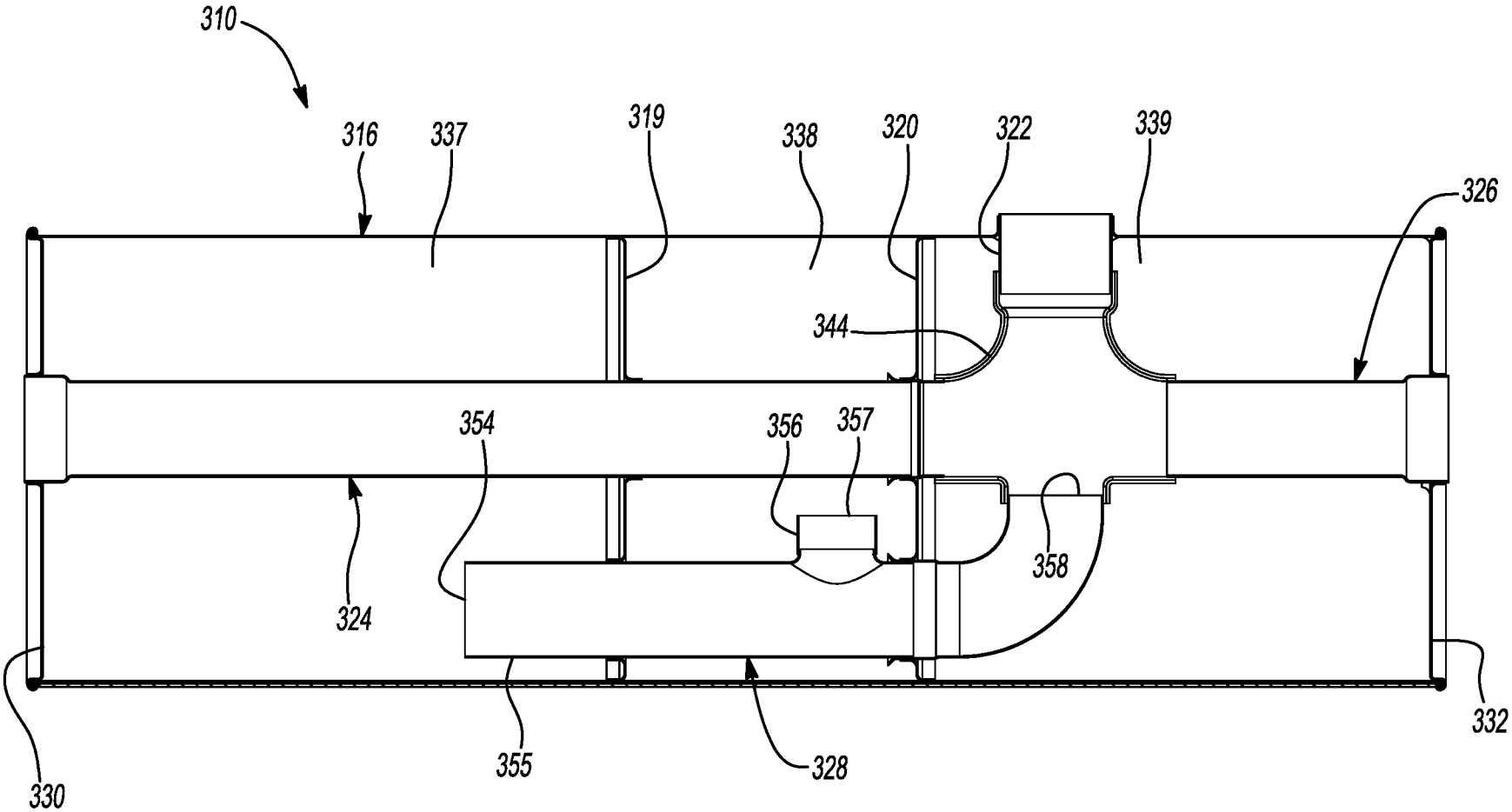
FIG. 8 is a cross-sectional view of yet another muffler according to the principles of the present disclosure.
Figure 9:
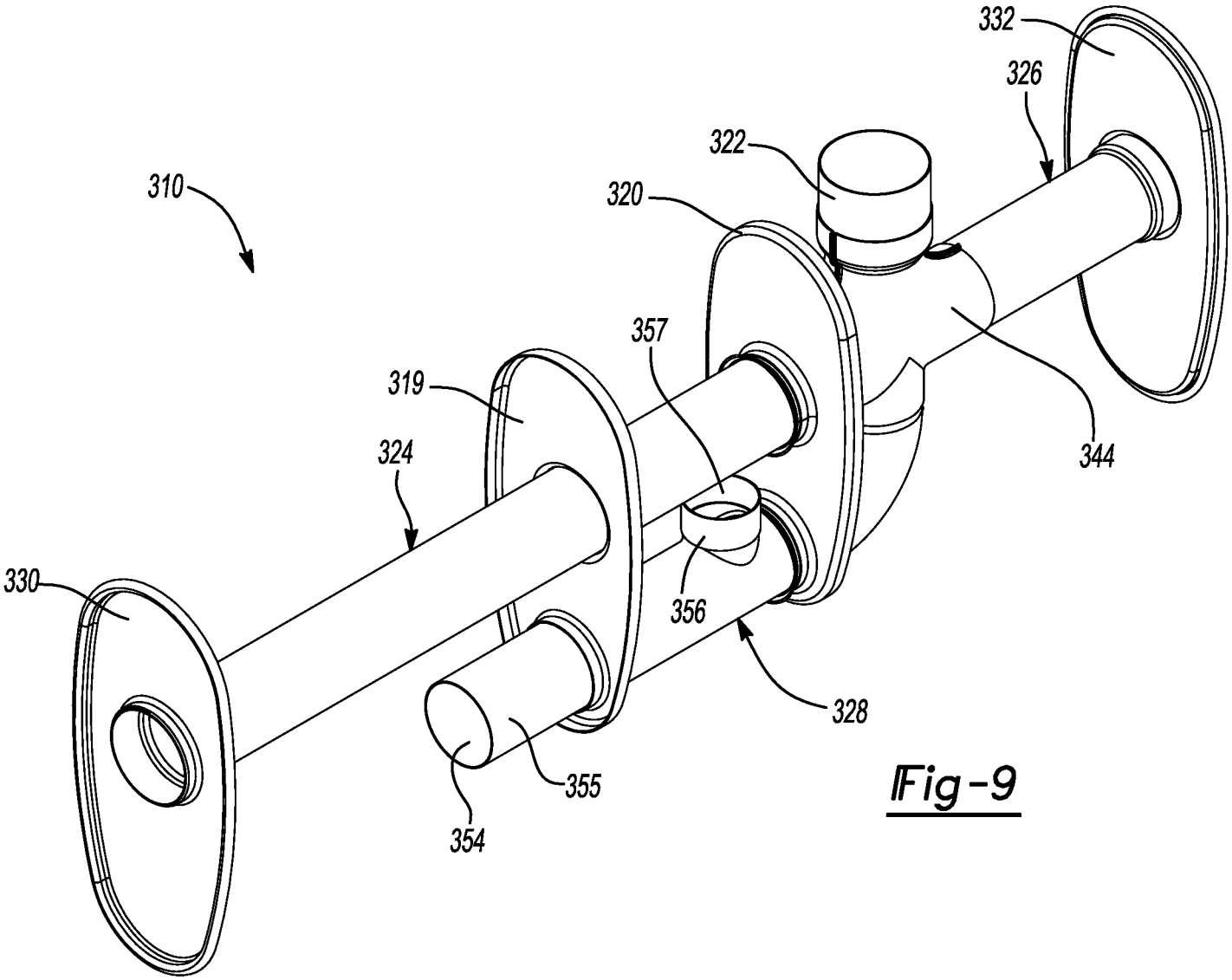
FIG. 9 is a perspective view of the muffler of FIG. 8 with a portion of an outer shell of the muffler removed.

Referring now to FIGS. 8 and 9, another muffler 310 is provided. Like the muffler 10, the muffler 310 may include a shell body 316, one or more baffles 319, 320, an inlet pipe 322, a first outlet pipe 324, a second outlet pipe 326, and an internal communication pipe (or tuning tube) 328. The structure and function of these components of the muffler 310 may be similar or identical to that of the corresponding components of the muffler 10 described above, apart from differing features described below and/or shown in the figures. Therefore, some similar features are not described again in detail.

The muffler 310 may include only one baffle or the muffler 310 may include a first baffle 319 and a second baffle 320, as shown in FIGS. 8 and 9. As shown in FIG. 8, the first baffle 319 may cooperate with the first end cap 330 and the main body of the shell 316 to define a first chamber 337. The first and second baffles 319, 320 may cooperate with each other and the shell 316 to define a second chamber 338 that is separated from the first chamber 337 by the first baffle 319. The second baffle 320 may cooperate with the second end cap 332 and the main body of the shell 316 to define a third chamber 339 that is separated from the second chamber 338 by the second baffle 320.

The inlet pipe 322 may include through the shell 316 and into the third chamber 339. A four-way junction 344 may be disposed within the third chamber 339 and may be fluidly coupled to the inlet pipe 322, the first outlet pipe 324, the second outlet pipe 326, and the internal communication pipe 328. The internal communication pipe 328 may extend from the four-way junction 344 in the third chamber 339, through the second baffle 320, through the second chamber 338, through the first baffle 319, and into the first chamber 337.

The internal communication pipe 328 may be similar or identical to the internal communication pipe 28, 128, 228. For example, the internal communication pipe 328 may be a dual Helmholtz tuner. A main body 355 of the pipe 28 opens into the first chamber 337 (via an outlet opening 354) and functions a first Helmholtz tuner (i.e., a direct driven tuner). A Helmholtz neck 356 (i.e., a second Helmholtz tuner) may extend radially into the second chamber 338 from an intermediate portion of the internal communication pipe 328 (i.e., at a location between the outlet opening 354 and the inlet opening 358 of the internal communication pipe 328). The Helmholtz neck 356 includes an outlet opening (or aperture) 357 that is in direct fluid communication with the second chamber 338.

In some configurations, the first chamber 337 may be a dead chamber (i.e., gas can enter and exit the first chamber 337 only through the outlet opening 354). In some configurations, the second chamber 338 may be a dead chamber (i.e., gas can enter and exit the second chamber 338 only through the outlet opening 357).

In some configurations, the first baffle 319 could include one or more apertures (e.g., like apertures 41 shown in FIG. 3) to allow fluid communication between the first and second chambers 337, 338. Additionally or alternatively, the second baffle 320 could include one or more apertures (e.g., like apertures 41 shown in FIG. 3) to allow fluid communication between the second and third chambers 338, 339.

While the mufflers 10, 110, 210, 310 shown in the figures have first and second outlet pipes 24, 26, 124, 126, 224, 226, in some configurations, the mufflers 10, 110, 210, 310 may have only a single outlet pipe. In such configurations, the four-way junction 44, 144, 244, 344 may be replaced with a three-way junction.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A muffler for receiving exhaust gas from a combustion engine, the muffler comprising:

a shell;

an inlet pipe extending through the shell and including an outlet positioned within the shell;

a first outlet pipe in fluid communication with the inlet pipe and at least partially disposed within the shell;

at least one baffle disposed within the shell and cooperating with the shell to define a plurality of chambers within the shell, wherein the chambers are separated from each other by the at least one baffle; and an internal communication pipe disposed entirely within the shell and directly coupled in fluid communication with the inlet pipe, the internal communication pipe includes an inlet opening, a first outlet opening, and a second outlet opening, the outlet of the inlet pipe being opposed to the inlet opening of the internal communication pipe, wherein the first outlet opening is open to and in direct fluid communication with one of the chambers, and wherein the second outlet opening is open to and in direct fluid communication with another one of the chambers, wherein the one of the chambers in direct fluid communication with the first outlet opening of the internal communication pipe is a first dead chamber, wherein the one of the chambers in direct fluid communication with the second outlet opening of the internal communication pipe is a second dead chamber.

2. The muffler of claim 1, wherein the inlet opening is formed in a first end of the internal communication pipe, wherein the first outlet opening is formed in a second end of the internal communication pipe, and wherein the second outlet opening is disposed between the first and second ends.

3. The muffler of claim 2, wherein the second outlet opening is formed in a neck that extends radially outward from a main body of the internal communication pipe.

4. The muffler of claim 2, wherein the second outlet opening extends radially through inner and outer diametrical surfaces of the internal communication pipe.

5. The muffler of claim 4, wherein the internal communication pipe includes a plurality of second outlet openings disposed between the first and second ends of the internal communication pipe.

6. The muffler of claim 2, wherein the internal communication pipe includes a first pipe section and a second pipe section, and wherein a portion of the second pipe section is received within first pipe section such that an annular space is defined between an outer diametrical surface of the second pipe section and an inner diametrical surface of the first pipe section.

7. The muffler of claim 1, wherein the internal communication pipe extends through at least two of the baffles and extends at least partially through at least three of the chambers.

8. The muffler of claim 7, wherein one of the at least two baffles includes one or more apertures allowing direct fluid communication between two adjacent chambers, and wherein one of the at least two baffles separates the chamber that is open to the first outlet opening from the chamber that is open to the second outlet opening.

9. The muffler of claim 1, further comprising a second outlet pipe in fluid communication with the inlet pipe and at least partially disposed within the shell.

10. The muffler of claim 1, wherein a plurality of baffles are disposed within the shell and cooperate with the shell to define the chambers.

11. A muffler for receiving exhaust gas from a combustion engine, the muffler comprising:

a shell;

an inlet pipe extending through the shell and including an outlet positioned within the shell;

a first outlet pipe in fluid communication with the inlet pipe and at least partially disposed within the shell;

at least one baffle disposed within the shell and cooperating with the shell to define a plurality of chambers within the shell, wherein the chambers are separated from each other by the at least one baffle; and an internal communication pipe disposed entirely within the shell and in fluid communication with the inlet pipe, the internal communication pipe includes an inlet opening, a first outlet opening, and a second outlet opening, the outlet of the inlet pipe being opposed to the inlet opening of the internal communication pipe, wherein the first outlet opening is open to and in direct fluid communication with one of the chambers, and wherein the second outlet opening is open to and in direct fluid communication with another one of the chambers, wherein the one of the chambers in direct fluid communication with the first outlet opening of the internal communication pipe is a first dead chamber, wherein the one of the chambers in direct fluid communication with the second outlet opening of the internal communication pipe is a second dead chamber, the muffler further comprising a second outlet pipe in fluid communication with the inlet pipe and at least partially disposed within the shell, wherein the inlet pipe, the first and second outlet pipes and the internal communication pipe are fluidly coupled to a four-way junction disposed within the shell.

12. A muffler for receiving exhaust gas from a combustion engine, the muffler comprising:

a shell;

an inlet pipe extending through the shell and including an outlet positioned within the shell;

a first outlet pipe in fluid communication with the inlet pipe and at least partially disposed within the shell;

at least one baffle disposed within the shell and cooperating with the shell to define a plurality of chambers within the shell, wherein the chambers are separated from each other by the at least one baffle; and an internal communication pipe disposed entirely within the shell and directly coupled in fluid communication with the inlet pipe, the internal communication pipe includes an inlet opening, a first outlet opening, and a second outlet opening, the outlet of the inlet pipe being opposed to the inlet opening of the internal communication pipe, wherein the first outlet opening is open to and in direct fluid communication with one of the chambers, and wherein the second outlet opening is open to and in direct fluid communication with another one of the chambers, wherein the one of the chambers in direct fluid communication with the first outlet opening of the internal communication pipe is a first dead chamber, wherein the one of the chambers in direct fluid communication with the second outlet opening of the internal communication pipe is a second dead chamber, wherein the inlet pipe, the first outlet pipe and the internal communication pipe are fluidly coupled to one another at a junction disposed within the shell.

13. The muffler of claim 12, wherein the inlet opening is formed in a first end of the internal communication pipe, wherein the first outlet opening is formed in a second end of the internal communication pipe, and wherein the second outlet opening is disposed between the first and second ends.

14. The muffler of claim 13, wherein the second outlet opening is formed in a neck that extends radially outward from a main body of the internal communication pipe.

15. The muffler of claim 12, wherein the internal communication pipe extends through at least two of the baffles and extends at least partially through at least three of the chambers.

* * * * *